US006408545B1

(12) United States Patent
Song

(10) Patent No.: US 6,408,545 B1
(45) Date of Patent: Jun. 25, 2002

(54) LEVEL MEASURING DEVICE INSTALLED WITH GOLF SHOES

(76) Inventor: Moon Ho Song, SSangyong Apartment 1-1501 Daechi-2-dong, Kangnamku, Seoul (KR)

( * ) Notice: Subject to any disclaimer, the term of this patent is extended or adjusted under 35 U.S.C. 154(b) by 0 days.

(21) Appl. No.: 09/688,648

(22) Filed: Oct. 16, 2000

(30) Foreign Application Priority Data

Jun. 5, 2000 (KR) ..... 00-15939

(51) Int. Cl.[7] ..... A43B 5/00; A43B 23/00

(52) U.S. Cl. ..... 36/127; 36/1; 36/136; 36/137

(58) Field of Search ..... 36/1, 127, 132, 36/136, 137; 362/205, 103, 800

(56) References Cited

U.S. PATENT DOCUMENTS 4,588,387 A * 5/1986 Swenson ..... 362/802
4,789,922 A * 12/1988 Cheshire ..... 362/802
5,463,537 A * 10/1995 Trattner et al. ..... 362/802
5,483,759 A * 1/1996 Silverman ..... 36/137
5,929,332 A * 7/1999 Brown ..... 36/136
5,945,911 A * 8/1999 Healy et al. ..... 36/137

* cited by examiner

*Primary Examiner*—M. D. Patterson
(74) *Attorney, Agent, or Firm*—Maria Parrish Tungol

(57) ABSTRACT

The golf shoes of the invention comprise a level-measuring device comprising a transparent square fixed box installed inside the heel of the golf shoes, a ball having a round shape and made of opaque material wherein the ball rolls freely inside of the fixed box according to the movement of the shoes; first and second infrared emitting diodes which emit infrared light signals inside the fixed box where ball rolls; front, back, right, and left photosensors, which each output a signal after perceiving infrared light signal from the diodes; a microprocessor, which outputs a signal indicating the state of the golf shoes according to the signal outputted from the photosensors; a display device which shows the current state of shoes according to the signal for state of shoes outputted from microprocessor; a battery which supplies power to the first and second infrared emitting diodes and microprocessor; and an on-off switch.

4 Claims, 3 Drawing Sheets

LEVEL MEASURING DEVICE INSTALLED WITH GOLF SHOES

FIELD OF THE INVENTION

The present invention relates to the golf shoes having a level- measuring device. More specifically, the present invention relates to the golf shoes having a level-measuring device for the golfer's accurate and easy recognition of the level position and slope.

BACKGROUND OF THE INVENTION

Generally, in case of the sports such as golf, the posture of the golfer is very important, and if the posture of the golfer is not correct, accurate putting or swinging motion cannot be established. In particular, the accurate posture of the golfer begins from the rigidly supported legs and at this time, it is important to keep up the level. For the purpose, the golf shoes play an important role, and therefore the specially produced shoes are chosen. Thus, the golf shoes are important for playing the golf by maintaining the level of the posture of the golfer. However, because there was not any means to confirm his posture by himself in case of the conventional sport shoes such as the golf shoes, his posture might be corrected only by his feeling or experience, or by other people.

Accordingly, the development of improved golf shoes solving the above defects has been desired. The present inventors have undertaken earnest studies in order to solve the above problems in the prior art, and as a result have found that the level measuring device according to the present invention installed on the golf shoes can make the golfer recognize the level position and the slope exactly.

SUMMARY OF THE INVENTION

The golf shoes of the invention comprise a level-measuring device comprising a transparent square fixed box installed inside of the heel; a ball having a round shape and made of opaque material wherein the ball rolls freely inside of the fixed box according to the movement of the shoes; first and second infrared emitting diodes which emit infrared light signals inside the fixed box where ball rolls; front, back, right, and left photosensors, which each output a signal after receiving infrared light signal from the diodes; a microprocessor, which outputs a signal indicating the position of the golf shoes according to the signal outputted from the photosensors; a display device on one side of the instep of the golf shoes, which shows the current position of shoes according to the signal for state of shoes outputted from microprocessor; a battery which supplies power to the first and second infrared emitting diodes and microprocessor; and on-off switch for the battery.

The above signal for the position of golf shoes are output signals like front high, back high, left high, right high and level according to signals being input from the front, back, left, or right photo sensor to the microprocessor.

The display device in the level measuring device according to the present invention is comprised of display lamps each arranged on four sides (forth, back, left, and right) around a center level display lamp wherein the lamps emit light depending on the signal of the position of the golf shoes being outputted from microprocessor.

Figure 1:
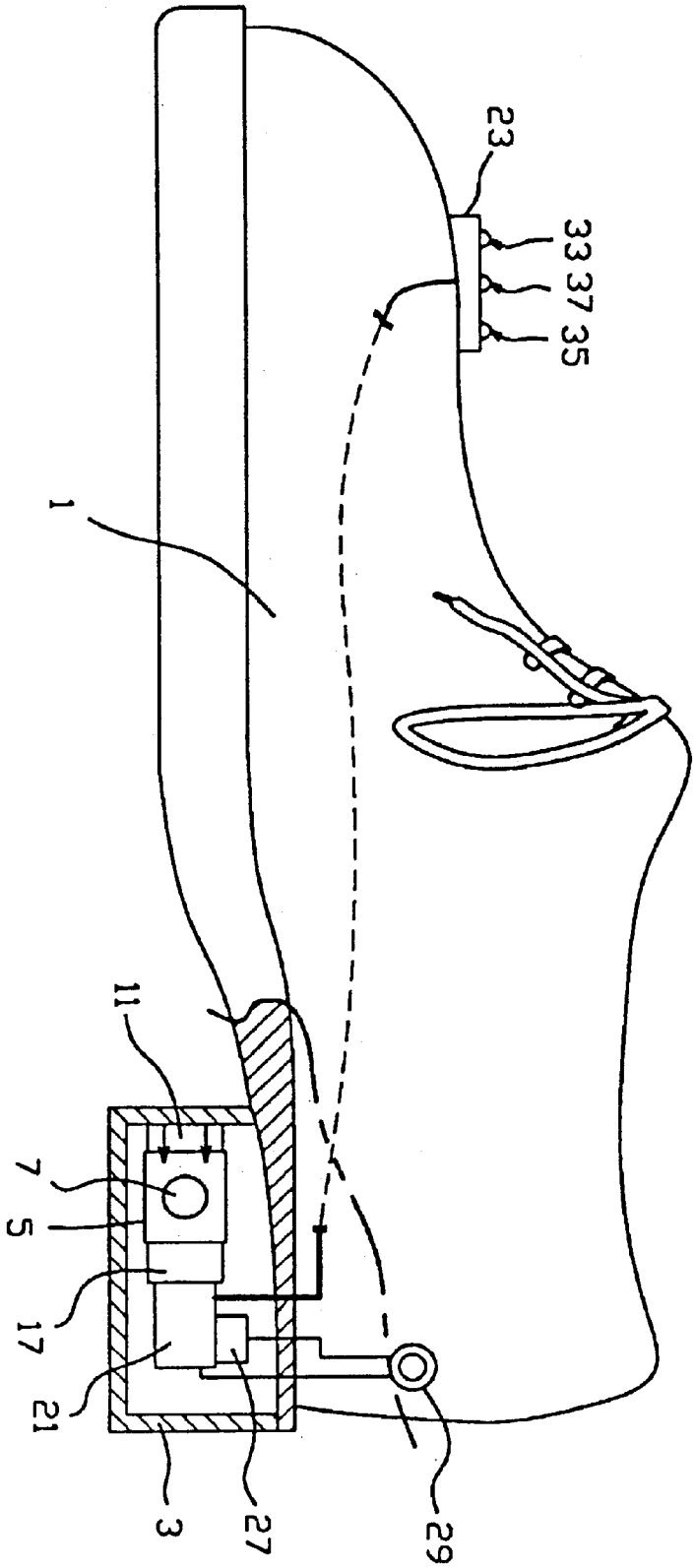
FIG. 1 is a side cross sectional view of golf shoes according to the present invention.
Figure 2:
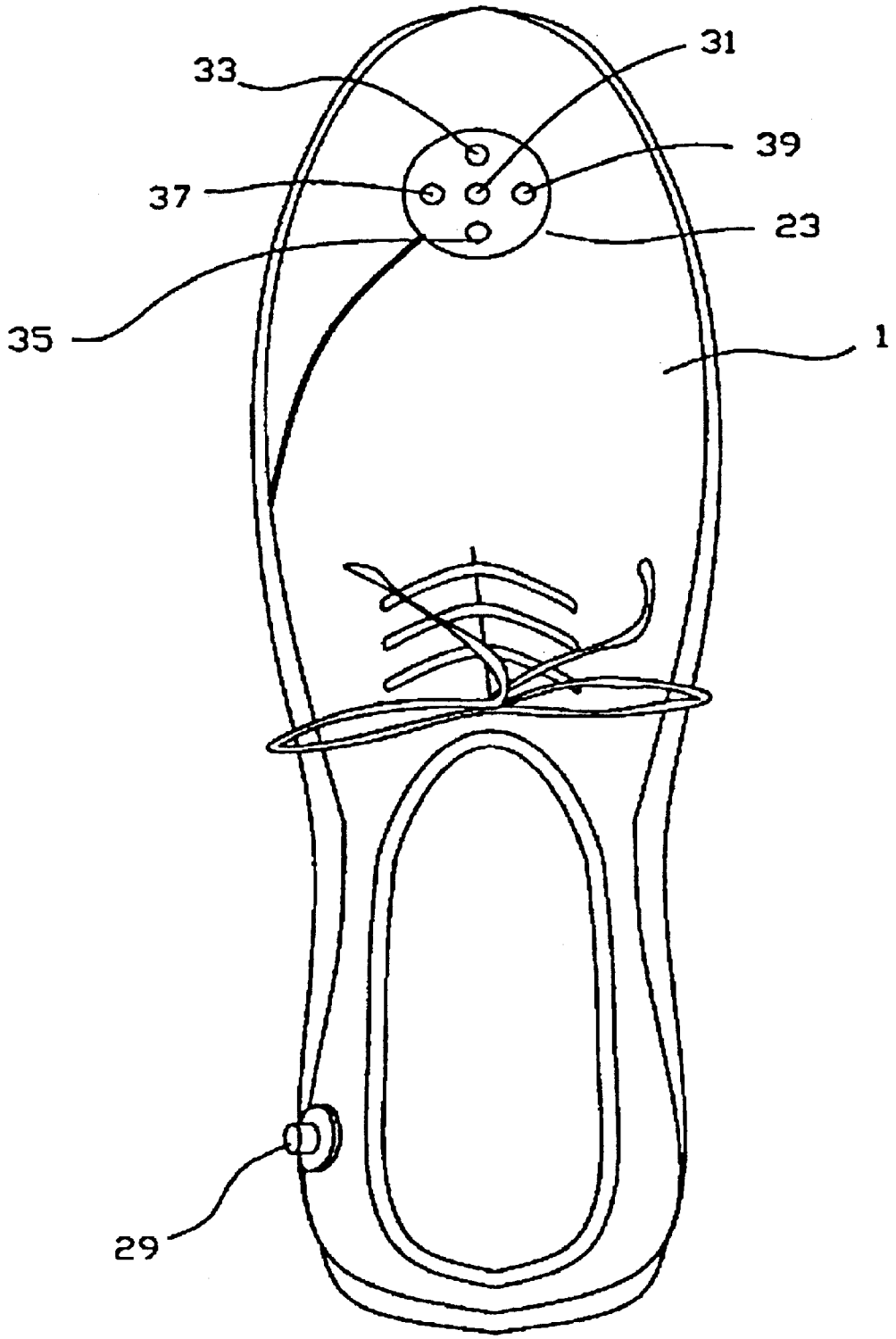
FIG. 2 is a plan view of the golf shoes of the invention.

The transparent square fixed box 5 is installed in the heel 3 of the golf shoes. The ball is typically round and is positioned inside the fixed box 5 where it rolls freely.

The first and second infrared emitting diodes 9, 11 which emit infrared light signal inside where the ball is rolling are installed at the outside of each of the front, back, right, and left sides of the fixed box. The front, back, right, and left photosensors 13, 15, 17, 19 are installed opposite the first and second infrared emitting diodes, in order to output signals on each side by sensing any infrared light signal which is emitted between ball and fixed box.

Microprocessor 21 which outputs a signal about the position of the golf shoes according to signal output from the front, back, right, and left photosensors inside of the heel of the golf shoes. The display device is comprised of display lamps 31, 33, 35, 37, 39 which indicate high and low positions of the golf shoes according to signal of state of shoes received from the microprocessor 21. The display device can be installed in the instep area of the golf shoes.

The signal for position of the golf shoes output has five kinds of electrical signals, front high, back high, left high, right high and level, according to whether the signal is inputted from the front, back, left, and right photosensors 13, 15, 17, 19 to the microprocessor 21.

The display device 23 is comprised of level lamp 31, which emits when the state of the golf shoes is level, and front, back, left, right lamps 33, 35, 37, 39, which emit according to the corresponding front, back, left, and right signal for state of the golf shoes from the microprocessor 21.

The battery to supply electrical power to the first and second infrared emitting diodes 9, 11 and the microprocessor 21 is positioned behind the heel of the golf shoes, and the electrical power on-off switch 29 can be installed in any position on the golf shoes where it can be easily operated by the golfer.

When the golfer wearing golf shoes 1 turns on the switch 29, the electrical power of battery 27 is supplied to the first and second infrared emitting diodes 9, 11 and the microprocessor 21.

Figure 3:
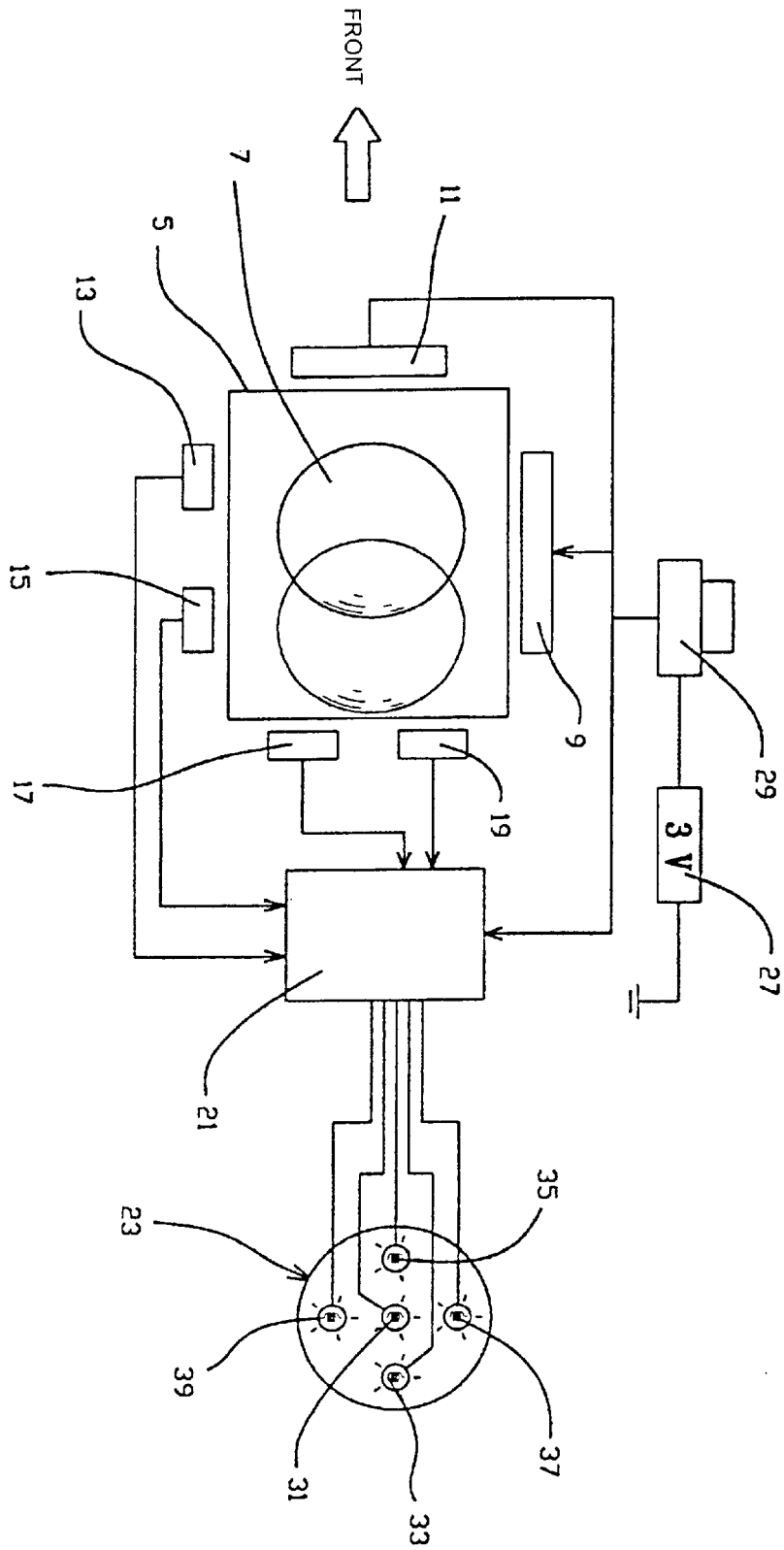
FIG. 3 is a diagram illustrating the level-measuring device according to the invention.

When a golfer wearing golf shoes 1 adjusts his posture according to the level of the field and/or the green, ball 7 moves to the low part of the heel. For example, as shown in FIG. 3, when ball 7 rolls to the back due to the higher position of the front of the golf shoes, the infrared light signal from infrared emitting diode 9 is emitted only to front photosensor 13 and an electrical signal is transmitted to the microprocessor 21. Since the signal was received from front photosensor 13, the microprocessor 21 sends a front high signal to the corresponding front display lamp 33. The golfer then is informed that the state of the shoes is front high since display lamp 33 is emitting.

When the back, left, or right side of the golf shoes is high, ball 7 rolls to the low part and the infrared signal emitted from the first or second infrared emitting diodes 9, 11 is received by the back, left, or right photosensor 15, 17, 19 depending upon which side is high. The signal of the state of the golf shoes is transmitted to microprocessor 21 which sends the corresponding signal (back high, left high, or right high) to the appropriate display lamp.

When the golf shoes are level, the ball 7 is in the center of the fixed box and none of the photosensors 13, 15, 17, 19 receive light from the first or second infrared emitting diodes 9, 11. Accordingly, the microprocessor 21 passes a level signal to display lamp 31.

The level measuring device according to the present invention enables a golfer to perceive the slope of a surface and the golfer can adjust putting direction and speed according to the slope of the surface.

Although there has been described what is at present considered to be the preferred embodiment of the invention, it will be understood that the invention may be embodied in other specific forms without departing from the essential characteristics thereof. The present embodiment is therefore to be considered in all respects as illustrative, and not restrictive.

What is claimed is:

1. A level measuring device installed in a heel of a golf shoe comprising:

a transparent box installed inside the heel, a ball of opaque material which rolls freely inside the box according to movement of the shoe;

first and second infrared emitting diodes for emitting infrared light from outside of the box to inside of the box wherein ball rolls;

front, back, right, and left photosensors which each outputs a signal after receiving infrared light signal from the diodes;

a microprocessor which outputs a condition signal indicating the position of the golf shoe according to a signal outputted from the photosensors;

a display device which shows the position of the golf shoe according to a signal outputted from the microprocessor;

a battery which supplies power to the first and second infrared emitting diodes and the microprocessor.

2. The level measuring device according to claim 1 wherein said signal from the microprocessor includes front, high, back high, left high, and right high and corresponds to a signal inputted from the front, back, left or right photosensors.

3. The level measuring device according to claim 1, wherein said display device comprises display lamps positioned around a center level display lamp on each of the front, back, left, and right sides of the central level display lamp wherein the display lamps emit light depending on the signal received by the microprocessor.

4. A level measuring device installed in a heel of a golf shoe comprising:

a transparent square box installed inside a heel, a ball of opaque material which rolls freely inside the box according to movement of the shoe;

first and second infrared emitting diodes for emitting infrared light from outside of the box to inside of the box wherein ball rolls;

front, back, right, and left photosensors which each outputs a signal after receiving infrared light signal from the diodes;

a microprocessor which outputs a condition signal of the golf shoe according to signal outputted from the photosensors;

a display device which shows the current state of the shoe according to signal outputted from the microprocessor;

a battery which supplies power to the first and second infrared emitting diodes and microprocessor; and an on-off switch for the battery.

* * * * *